US005401184A

United States Patent [19]

Sundstrom et al.

[11] Patent Number: 5,401,184

[45] Date of Patent: Mar. 28, 1995

[54] FACE PLATE FOR SECURING A WATERPROOF CONNECTION BETWEEN ELECTRICAL PLUG AND RECEPTACLE

[75] Inventors: Robert A. Sundstrom; Donald R. Dumont, both of Hudson, N.H.

[73] Assignee: Lynx Enterprises, Inc., Nashua, N.H.

[21] Appl. No.: 53,096

[22] Filed: Apr. 26, 1993

Related U.S. Application Data

[63] Continuation-in-part of Ser. No. 940,464, Sep. 4, 1992.

[51] Int. Cl.[6] ..... H01R 13/62

[52] U.S. Cl. ..... 439/367; 439/373; 174/67; 29/235

[58] Field of Search ..... 439/367, 369, 371, 373, 439/521, 523, 535, 536, 651, 652; 174/67; 29/235, 237, 450

[56] References Cited

U.S. PATENT DOCUMENTS

| | | | |
|---|---|---|---|
| 2,716,225 | 8/1955 | McCubbin | 439/373 X |
| 3,059,209 | 10/1962 | Bird . | |
| 3,159,446 | 12/1964 | Protzmann | 439/373 X |
| 3,571,782 | 3/1971 | Colbert . | |
| 4,180,303 | 12/1979 | Damsky | 439/652 X |
| 4,531,800 | 7/1985 | Avener | 439/373 |
| 4,944,685 | 7/1990 | Schulte . | |
| 5,080,598 | 1/1992 | Shotey | 439/367 X |
| 5,147,216 | 9/1992 | Shotey . | |
| 5,217,387 | 6/1993 | Hull et al. | 439/369 X |

FOREIGN PATENT DOCUMENTS

| | | |
|---|---|---|
| 0715611 | 1/1942 | Germany . |
| 0083033 | 4/1920 | Switzerland . |

*Primary Examiner*—Khiem Nguyen
*Attorney, Agent, or Firm*—Davis, Bujold & Streck

[57] ABSTRACT

A face plate for an electrical outlet having a pair of bosses each supporting, on an exterior surface thereof, a resilient elongate tubular member formed from a substantially water impermeable material for encasing a plug and the boss. The tubular member has opposed open first and second ends with the first end dimensioned to engage an exterior surface of the boss and a second portion dimensioned to pass over the plug and be resiliently expanded thereby to minimize penetration of liquid between the tubular member and the plug to achieve a substantially waterproof engagement therebetween.

20 Claims, 8 Drawing Sheets

FACE PLATE FOR SECURING A WATERPROOF CONNECTION BETWEEN ELECTRICAL PLUG AND RECEPTACLE

This application is a continuation-in-part of U.S. patent application No. 07/940,464, filed Sep. 4, 1992.

The present invention relates to a tubular member which is capable of encasing two interconnect members, such as a male electrical member (plug) with an electrical outlet, and minimizing penetration of liquid or moisture between the interconnected members to achieve a substantially waterproof connection. The tubular member also functions to maintain the two interconnected members in engagement with one another.

BACKGROUND OF THE INVENTION

A variety of such connection devices are known in the art but such known devices are generally cumbersome to utilize and are not particularly adapted for maintaining a substantially waterproof connection between the two interconnect members.

Further, when a male electrical member is connected to an electrical outlet, it is readily disconnected from the electrical outlet when the electrical cord, to which the male electrical member is connected, is accidently tripped over or tugged at to create a disconnecting force away from the electrical outlet.

SUMMARY OF THE INVENTION

Wherefore, it is a primary object of the invention to provide a tubular member for providing a substantially waterproof engagement between two interconnected engaged members and to prevent disconnection of those two members in the event that a force, tending to dislodge the two interconnected members, is applied.

Another object of the invention is to provide a tubular member which is relatively simple and inexpensive to manufacture and relatively easy to employ.

A further object of the invention is to provide a tubular member which is durable yet relatively flexible so that the tubular member has an extended operating life.

A still further object of the invention is to provide a tubular member which is substantially impermeable to liquid and moisture to reduce the possibility of an electrical short occurring between two interconnected electrical members when the tubular member is employed in an outdoor environment.

A still further object of the invention is to provide a reinforced tubular member which minimizes the axial stretch thereof to minimize the possibility of the two members from becoming disconnected from one another.

Another object of the invention is to provide a face plate for an electrical outlet with a supporting surface, for supporting the tubular member, for maintaining an electrical connection between a male connecting member of an electrical device and the electrical outlet.

Briefly, the present invention relates to an electrical outlet receptacle connecting member comprising an elongate boss defining an exterior surface with opposed first and second ends, the first end the boss being configured to be encased by a resilient waterproofing tubular member and a second end of the boss for communicating with the receptacle to prevent liquid from accessing the plug; and opening means, being formed in the first end of and being encompassed by the boss, for providing for an electrical connection between a plug and a receptacle of an electrical outlet. The present invention also relates to a face plate or electrical outlet an incorporating the same.

The present invention further relates to a method of achieving a substantially waterproof connection between a plug and a receptacle of an electrical outlet via an electrical outlet receptacle connecting member comprising an elongate boss defining an exterior surface with opposed first and second ends, the first end the boss being configured to be encased by a resilient waterproofing tubular member and a second end of the boss for communicating with the receptacle to prevent liquid from accessing the plug; and opening means, being formed in the first end of and being encompassed by the boss, for providing for an electrical connection between a plug and a receptacle of an electrical outlet; said method comprising the steps of forming an electrical connection between the plug and a receptacle via said opening means; and encompassing said boss and the plug with the resilient waterproofing tubular member to form a substantial water connection therebetween.

DESCRIPTION OF THE DRAWINGS

The above and other objects of the invention will be further understood by having reference to the accompanying drawings which illustrate, by way of example, preferred embodiments of the invention. It being understood that other embodiments employing the same or similar principles will be apparent to those skilled in the art.

DESCRIPTION OF THE PREFERRED EMBODIMENTS

Figure 1A:
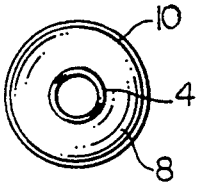
FIG. 1A is a diagrammatic left end elevational view of a tubular member shown in FIG. 1.

Turning now to FIGS. 1-5 of the drawings, the device for achieving a substantial waterproof connection between two interconnected engaged members will now be described in detail. The device comprises an elongate hollow tubular member 2 defining a central longitudinal axis L. The tubular member 2 has a first portion 4 located adjacent a first open axial end 5 thereof and a second portion 6 located adjacent an opposite second open axial end 7 of the tubular member. A lip 10 is provided adjacent the second open end of the tubular member to assist with rolling of the tubular member. The tubular member 2 is manufactured from a material substantially impermeable to liquid and/or moisture, such as vinyl plastisol, polyvinyl chloride, nitrile latex, rubber latex, acrylic latex, liquid neoprene, butyl rubber, thermoplastic elastomer, thermoset plastic, plastic, polypropylene, plasticizer or any combination of the above and has a thickness of from about 15 to 200 mils and an axial length of from about 1 to 18 inches. Other materials which have similar physical properties and characteristics may also be utilized.

An important aspect of the present invention is that the material used to manufacture the tubular member must be sufficiently flexible to facilitate rolling of the tubular member into a rolled up "donut" shaped configuration (FIG. 8), the purpose of which will be explained in detail hereinafter, while maintaining the integrity, durability and reusability of the tubular member.

Figure 2:
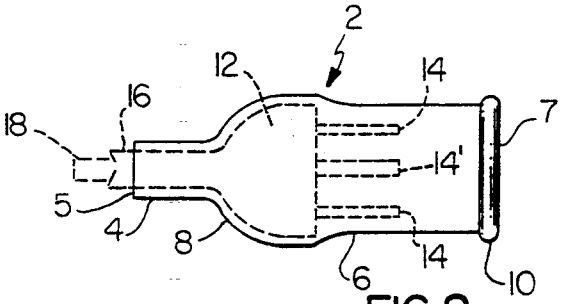
FIG. 2 is a diagrammatic representation of the tubular member of FIG. 1 with a conductor member shown in ghost.

FIG. 2 diagrammatically shows engagement of the tubular member 2 with a first (male) connector member 12. The first connector member 12 has two male contacts 14 and has a ground contact 14' projecting from a first end thereof. An opposite end of the first connector member 12 is connected to an outer casing 16 encasing transmission means 18, such as three electrical wires 20, interconnected with the contacts 14, 14'. The first portion 4 of the tubular member 2 is dimensioned to closely surround and encase the outer casing 16 (cord). The first portion 4 may intimately engage with the outer casing 16 to provide a substantially water tight seal between the first portion and the outer casing.

The second portion 6 is larger than the first portion but is dimensioned to be smaller than the outer dimension of the first connection member 12 so that the second portion 6 expands when the connection member 12 is encased by the second portion 6 of the tubular member 2.

Figure 1:
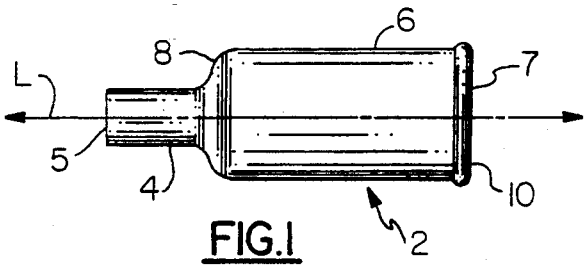
FIG. 1 is a diagrammatic front elevational view of a first embodiment of a tubular member according to the present invention.
Figure 3:
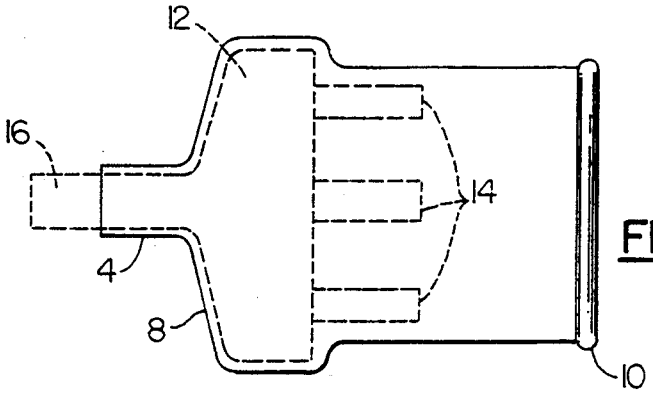
FIG. 3 is a diagrammatic representation showing a second embodiment of the tubular member with a conductor member shown in ghost.
Figure 4:
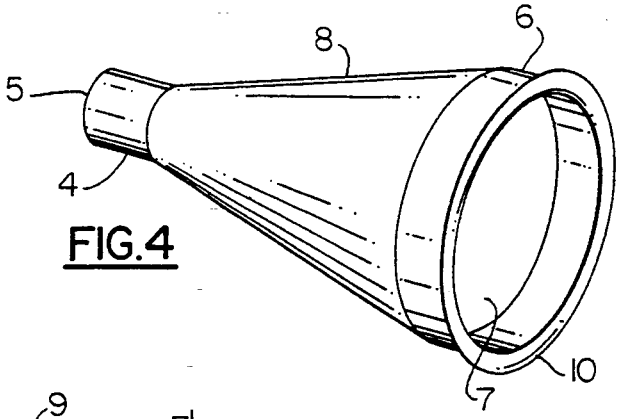
FIG. 4 is a diagrammatic perspective view of a third embodiment of the tubular member.

A transition 8 is formed between the first portion 4 and the second portion 6 of the tubular member. The transition 8 shown in FIGS. 1-3 is an integral curved, gradual transition while the transition shown in FIG. 4 is an integral tapered transition. It is to be appreciated that the transition can have any desired shape and/or configuration, depending upon the application at hand.

FIG. 3 shows a variant of the tubular member in which the first connector member 12 encased by the tubular member 2 is significantly larger, e.g. for a 220 volt electrical plug and cord. Accordingly, the dimensions of the first and second portions of the tubular member 2 are relatively larger but are still designed so that the first portion closely engages with the outer casing 16 while the second portion is expanded when the connection member 12 is encased thereby. It is to be appreciated that the dimensions of the first portion 4, the second portion 6 and the transition 8 located therebetween can vary depending upon the application. An important aspect of the present invention is that the second portion be in an expanded condition, approximately 10 to 100 percent expanded, when the connection member 12 is encased therein, so that the second portion achieves a snug and substantially waterproof engagement between the second portion and the two connection members.

Figure 5:
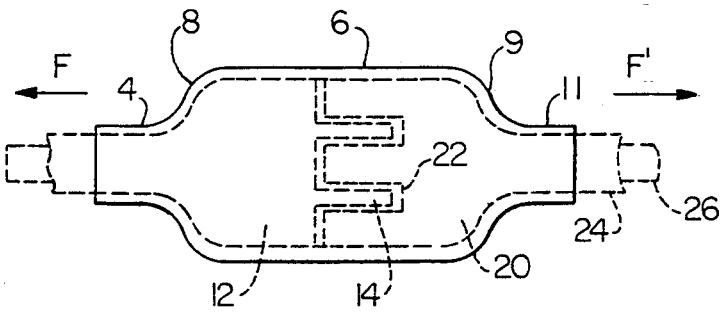
FIG. 5 is a diagrammatic representation showing a forth embodiment of the tubular member with two interconnected members shown in ghost.

FIG. 5 shows a fourth embodiment in which the tubular member further includes a third portion 11 located between the second portion 6 and the second opposed axial end 7 and a second transition 9 located between the third portion 11 and the second portion 6. The third portion 11 of the tubular member 2 is dimensioned to closely surround and encase the outer casing (cord) 24. In this embodiment, better waterproofing is achieved, especially if the third portion is sized to intimately engage with the outer casing 24 of the second conductor member 20. The second conductor member 20 has mating female recess (contacts) 22 connected to second transmission means 26.

Figure 6:
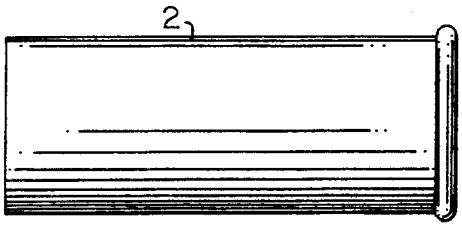
FIG. 6 is a diagrammatic front elevational view of a fifth embodiment of the tubular member.

FIG. 6 shows an embodiment in which the entire tubular member is of the same dimension, i.e. the tubular member 2 comprises solely the second portion 6 which is dimensioned slightly smaller than the outer dimensions of the connection members to be accommodated therein so that the second portion expands when the connector members are encased thereby.

Figure 6A:
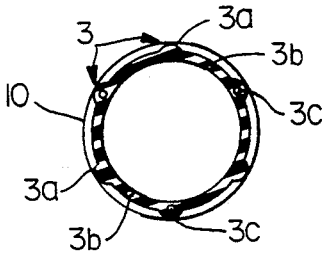
FIG. 6A is a diagrammatic cross sectional view of a sixth embodiment of the tubular member.

Turning now to FIG. 6A, any one of the previous embodiments of the tubular member may be provided with a plurality of equally spaced reinforcing means 3, such as ribs 3*a*, embedded strands or embedded threads 3*b*, or ribs reinforced with strands of threads 3*c*, etc. The ribs are areas which are reinforced by depositing additional material, in an axially extending direction, at desired locations of the exterior surface of the tubular member.

The strands or threads accommodated within the tubular member or ribs can be either fiber glass monofilament, nylon, cotton, polyester, rayon, steel, aluminum, copper, brass, or other similar materials which axially strengthen the tubular member. The reinforcing means 3 are designed to be flexible while minimizing axial stretch of the tubular member when a disconnecting force F is applied to the tubular member.

The reinforcing strands are either molded or embedded within the support ribs during production of the tubular member or they may be added to an existing tubular member 2 by applying the strands to an exterior surface of a tubular member and thereafter adding additional latex or another substance to adhesively secure the strands to the exterior surface of the tubular member.

Figure 7:
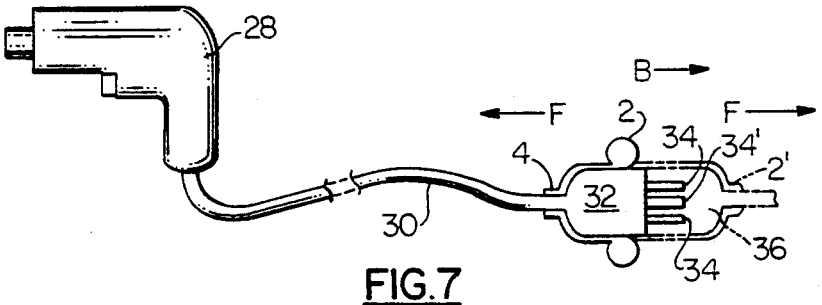
FIG. 7 is a diagrammatic representation showing the tubular member attached an electrical plug of an electrical tool.

Turning now to FIG. 7, one use of the tubular member of the present invention is diagrammatically shown. An electrical tool 28 is connected to one end of an electrical cord 30 while the opposite end of the electrical cord 30 is connected to a male electrical plug 2 having male contacts 34, 34'. As can be seen in this figure, the tubular member 2 is in a partially rolled up configuration in which the first portion 4 is in intimate engagement with an outer surface of the electrical cord 30 while a part of the second portion engages with the exterior surface of the male plug 32. The remainder of the second portion is in the rolled up condition to facilitate the use of the device, i.e. unrolling in the direction of arrow B, as will be explained below.

Once the male plug 32 is connected to a female electrical plug 36 of, for example, an extension cord (shown in ghost in FIG. 7), the device 2 is unrolled in the direction of arrow B into a substantially completely unrolled condition 2' (shown in ghost). Once in this unrolled condition 2', the inherent resiliency of the material from which the tubular member 2 is manufactured provides a substantially waterproof connection and assists with preventing undesired disconnection of the two interconnected members when a force F is applied substantially along the longitudinal axis of the mating plugs 32, 36 and tending to disconnect the two engaged plugs from one another. The tubular member, due to its material's inherent resiliency, absorbs any minor disconnection force(s) F and tends to draw the two connection members back into a proper engagement with one another, if the force F was significant enough to partially disconnect the two plug members from one another. It is to be appreciated that the amount of expansion undergone by the tubular member will effect the sealing and connection ability, i.e. the greater the expansion the greater the sealing force and the ability of the tubular member to prevent the two interconnected members from being disconnected from one another. Furthermore, as the tubular is manufactured from a material which is essentially impermeable to liquid and/or moisture, the possibility of an electrical short resulting from use of the tubular member in an outdoor environment is minimized.

Figure 8:
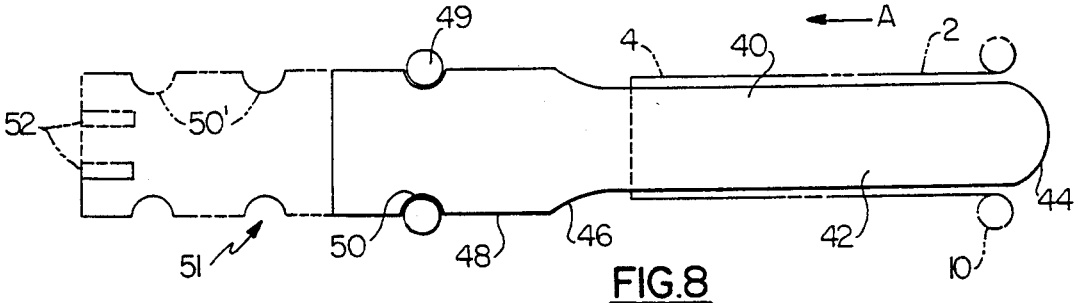
FIG. 8 is a diagrammatic representation showing an apparatus for facilitating rolling and transferring of the tubular member onto a desired member.
Figure 9:
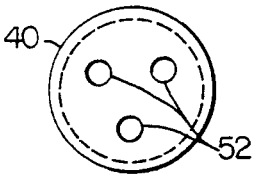
FIG. 9 is a diagrammatic left end elevational view of the apparatus shown in FIG. 8.
Figure 10:
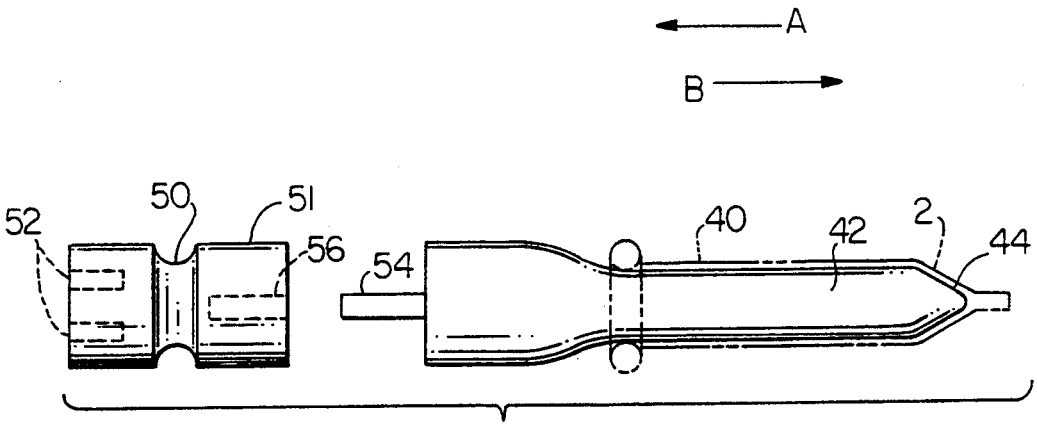
FIG. 10 is a diagrammatic representation of a second embodiment of an apparatus for facilitating rolling and transferring of the tubular member onto a desired member.

Turning now to FIGS. 8 and 9, an apparatus for facilitating rolling of the tubular member into the "donut" configuration 49 and for transferring the tubular member to a desired connector member will now be described. The apparatus 40 comprises a metal, wooden or plastic elongate tubular portion 42 having an axial length substantially at least as long as the axial length of the tubular member to be rolled up. The tubular portion has an outer dimension substantially equal to the inner dimension of one of the first and second portions of the tubular member to be rolled up. The apparatus 40 has a first rounded end 44 to facilitate passing of the tubular member onto the apparatus 40. The first end 44 may also be tapered, if desired (FIG. 10). A spool 51 is formed integrally with the apparatus 40, opposite the first end 44, with a tapered portion 46 integrally formed between the elongate tubular portion 42 and the spool 51.

Figure 11:
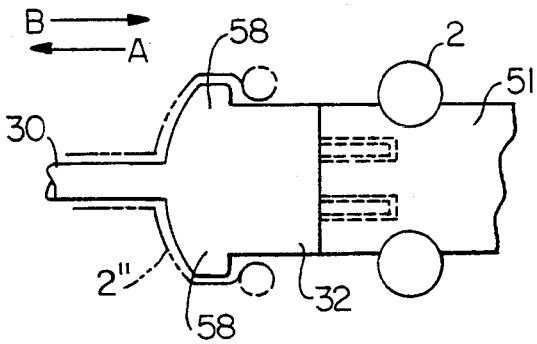
FIG. 11 is a diagrammatic representation showing the transfer of the tubular member from a spool onto a male electrical plug.

The spool 51 is an elongate cylindrical member having at least one annular recess 50 provided in an exterior surface thereof. As shown in ghost in FIG. 8, the axial length of the spool and the number of annular recesses 50 formed therein may be increased, as desired, to facilitate supporting a plurality of rolled up tubular members 2 thereon, e.g. the spool may have three annular recesses 50. A plurality of apertures 52 for engaging the male contacts or other protrusions of the male connector member are provided adjacent the spool end of the apparatus 42. Alternatively, a flat surface or a plurality of protrusions, for engaging female contacts of a female connector member to which the tubular member is to be applied, may be provided adjacent the spool end of the apparatus. The plurality of apertures 52, in use, receive the male contacts 34 of a male plug to provide abutting engagement between the spool 51 and the male plug 32 to facilitate transfer of the rolled up tubular member onto the male plug 32 (FIG. 11).

In order to roll up the tubular member, the tubular member 2 is first passed or slid onto the apparatus 40, the first portion 4 end first with the lip 10 being located adjacent the first end 44, the lip 10 is next rolled to the left, as shown by arrow A in FIG. 8, until the tubular member has been completely rolled up. Thereafter, further rolling movement of the tubular member toward the left occurs until the rolled up "donut" configuration tubular member 49 is accommodated within one of the annular recesses 50, where it is temporarily stored for later use.

The apparatus 40 shown in FIG. 10 is functionally equivalent to that shown in FIG. 8, but the rolling apparatus 40 and the spool 51 are formed as two separate components. In addition, the end of the apparatus, opposite the first end 44, has a protrusion 54 which engages with a mating recess 56, provided in the end of the spool 51 opposite the plurality of apertures 52, to facilitate proper alignment and engagement of the apparatus 40 with the spool 51. Other known interconnections between these two members may also be utilized.

As can be seen in FIG. 10, the tubular member 2 is inserted onto the apparatus 40 lip end first, i.e. the second portion 6 is accommodated by the tubular portion 42 and the first portion 4 is located adjacent the tapered end 44. As the tubular portion 42 is preferably sized to engage with an interior surface of the second portion, or slightly smaller, rolling in the direction of arrow B is facilitated. Once the tubular member is substantially completely rolled up, the tubular member is pulled off the rolling apparatus 40 and turned around and then rolled back onto the apparatus 40 in the direction of arrow A so that it may be rolled on to the spool 51, after the apparatus 42 is connected to the spool 51, via the mating protrusion and recess 54, 56.

It is important to note that when rolling the tubular member into a "donut" configuration 49, the lip end 10 must be rolled toward the first portion 4 so that the first portion 4 forms the exterior of the "donut" configuration, i.e. is the first part of the tubular member to be unrolled. Thus, when the tubular member is installed on a desired connector member, the first portion can be positioned adjacent the outer casing of the first connector member and be properly positioned.

The installation of tubular member 2, once rolled up, onto a desired connector member can be seen with reference to FIG. 11. Once the spool is properly engaged with the male plug 32, i.e. the male contacts 34 engaged with the plurality of apertures 52, the tubular member is rolled in the direction of arrow A over the male plug 32 onto the outer casing 30. Thereafter, the device is partially unrolled, i.e. rolled in the direction of arrow B, until the tubular member partially encases the connector member 2, as can be seen in ghost in FIG. 11, and ready for use. In order to assist with maintaining the tubular member in the partially unrolled condition shown in FIG. 11, the connector member 32 may be provided with opposed radially protrusions or a radially extending annular member 58 which aids with preventing the tubular member from being rolled in the direction of arrow A toward the second portion. The protrusion means 58 assists with maintaining the tubular member in a position for ready use, once installed.

Figure 12:
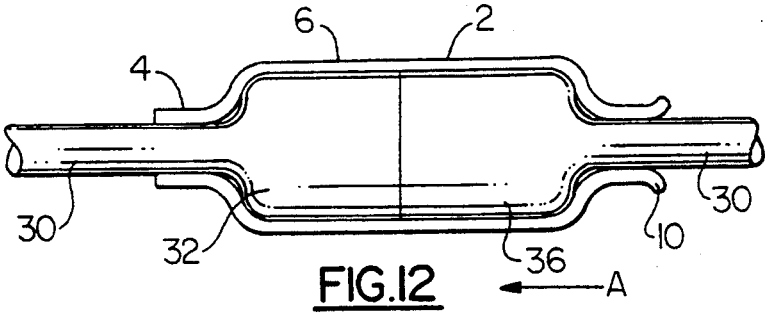
FIG. 12 is a diagrammatic representation showing the engagement between the tubular member of FIG. 1 and two interconnected members.
Figure 17:
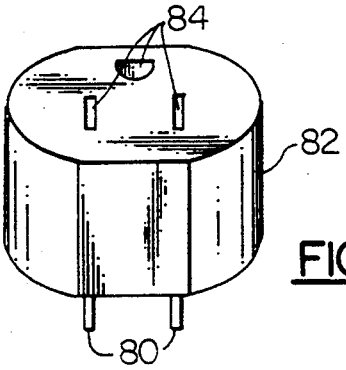
FIG. 17 is a diagrammatic perspective view of the intermediate member of FIG. 14.

When a mating female connection member, such as the female end of an extension cord, is brought into mating engagement with the electrical plug 32, the tubular member 2 is rolled in direction of arrow B until it encases a substantial portion of the female connection member and intimately engages and seals the outer surfaces of the interconnected male and female members (FIG. 12). Preferably, the second portion will entirely encase the second connector member as well as substantial part of the first connector member.

When disconnection of the two interconnected members is desired, the lip 10 is rolled in the direction of arrow A (FIG. 12) until the tubular member no longer engages the female member 36 and the tubular member is thus in a partially rolled up condition ready for further use. The female member can then be readily disconnected from the male connector member 32.

Figure 13:
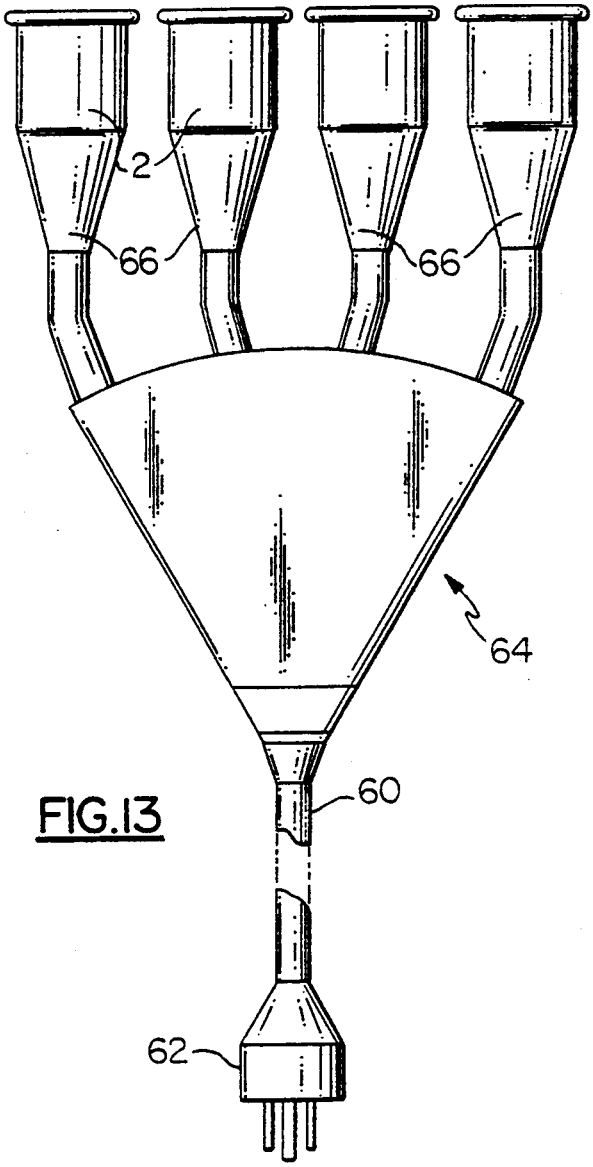
FIG. 13 is a diagrammatic representation of an embodiment showing a plurality of the tubular members attached to a plurality of female electrical plug members.

Turning now to FIG. 13, a further embodiment of the present invention can be seen. In this embodiment, an electrical extension cord 60 has a male plug 62 connected adjacent one end thereof and female connection means 64 connected adjacent the opposite end of the cord 60. The female connection means 64 branches into four separate female electrical plug members 66. Each female electrical plug member supports a partially rolled up tubular member 2. When a female electrical plug member 66 engages a male electrical plug member (not shown), the tubular member 2 is unrolled over the male electrical plug member to encase the two interconnected members. This arrangement is particularly useful at a construction site where more than one user may desire to be connected to an electrical power supply. In the event that a tubular member 2 is also supported by the male electrical plug member to be engaged with the female electrical plug member (e.g. FIG. 7), one of the tubular members is be rolled away from its associated connector member so that the other tubular member can be used to encase the two interconnected members.

Turning now to FIGS. 14–18, a first embodiment of a face plate, according to the present invention, will now be discussed. The face plate 70 is a rectangular member and defines a plane P. The end plate 70 is secured to an electrical outlet 76 by attachment means 72, such as one or more screws engaging within an aperture 74 of the electrical outlet 76. The face plate 70 may either be a substantially planar member or may be slightly dome shaped, with a flat central portion, to accommodate two or more electrical receptacles 77 which protrudes slightly from an electrical outlet 76 mounted within a wall W. As such face plates are generally known in this art, further detailed discussion concerning the same is not provided herein. To ensure a waterproof connection between the face plate 70 and the electrical outlet 76, a perimeter seal 81 is provided therebetween.

Figure 16:
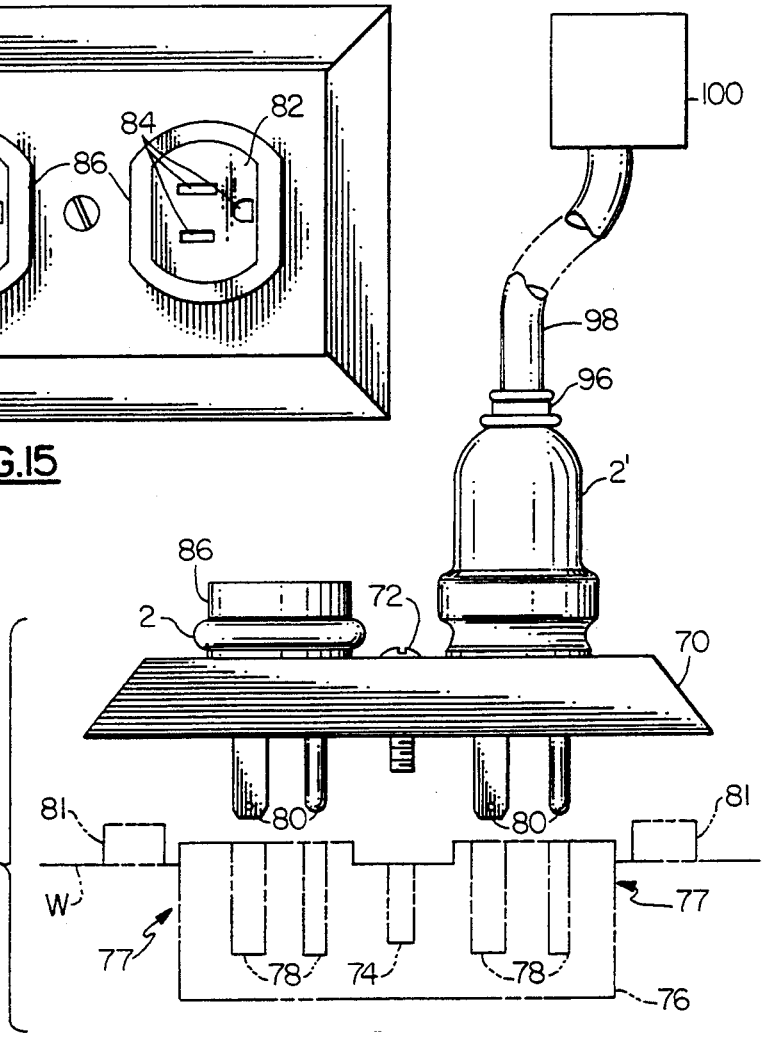
FIG. 16 diagrammatically shows operation of the face plate of FIG. 14.

As can be seen in FIG. 16, the electrical outlet 76 has two receptacles 77 which each contain a plurality of female contacts, i.e. generally two female contacts and one ground contact. Two bosses (housings) 86, each defining an axis A which extends substantially perpendicular to the plane P, extend from and are integral with a first planar surface of the face plate 70. Each boss 86 is generally cylindrical or oval in shape and is provided with an annular groove or circumferential recess 88 formed in an exterior surface of the boss. The purpose of the recess 88 is to accommodate the tubular member, when its in its rolled up configuration (FIG. 16). An insert member 82 is accommodated within each boss 86 and is made of an insulating or non-conductive material, such as ceramic. The insert member 82 (FIG. 17) supports a plurality of female contacts, i.e. two female contacts and one ground contact, on a surface thereof remote from the face plate and also supports a plurality of male contacts, i.e. two male contacts and a ground contact on an opposed surface thereof adjacent a second surface of the face plate. Each female contact 84 is directly wired or connected with a corresponding male contact 80 to form an electrical connection therebetween. The insert member 82 is very similar to the adapters which are presently available to adapt a three pronged grounded plug to a two pronged ungrounded receptacle. Accordingly, as such teaching is well known in the art, further discussion concerning the same is not provided herein.

The male contacts 80 project substantially perpendicularly from the second surface of the face plate 70 (FIG. 16) to facilitate engagement with the female contacts 78 of a desired receptacle 77. The insert member 82 is glued or otherwise permanently secured to an inner surface of the boss 86 to become integral therewith.

Once the face plate 70 is securely attached to an electrical outlet, via the attachment means (screw) 72, the female contacts 84 are positioned for engagement with male contacts of a desired electrical plug 96 (FIG. 16). Accordingly, when male contacts of a plug 96, connected to an electrical appliance or device 100 via an electrical cord 98, engage with the female contacts 84 of the intermediate member 82, an electrical connection with the electrical outlet 76 is achieved. In order to achieve a substantially water proof connection and/or minimize the possibility of the plug 96 becoming unintentionally disconnected from the electrical outlet 76, the tubular member 2 is unrolled from recess 88 over the exterior surfaces of the boss 86 and the plug 96. Once the tubular member is in this unrolled condition 2' a disconnecting force F will be substantially absorbed by the tubular member 2.

Figure 14:
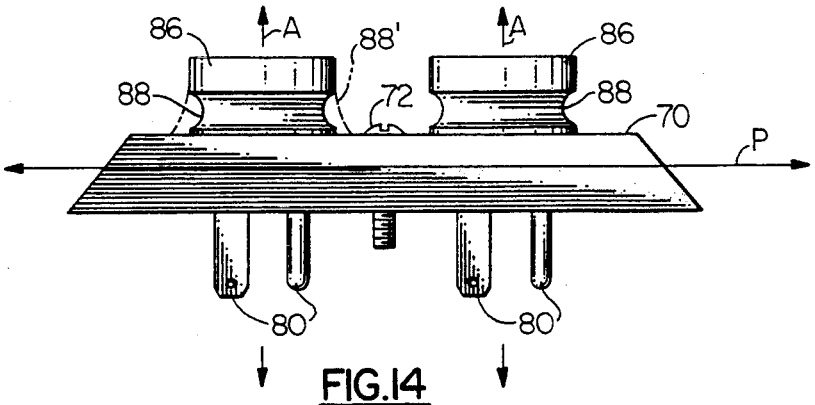
FIG. 14 is a diagrammatic left end view of a first embodiment of a face plate for an electrical outlet according to the present invention.
Figure 15:
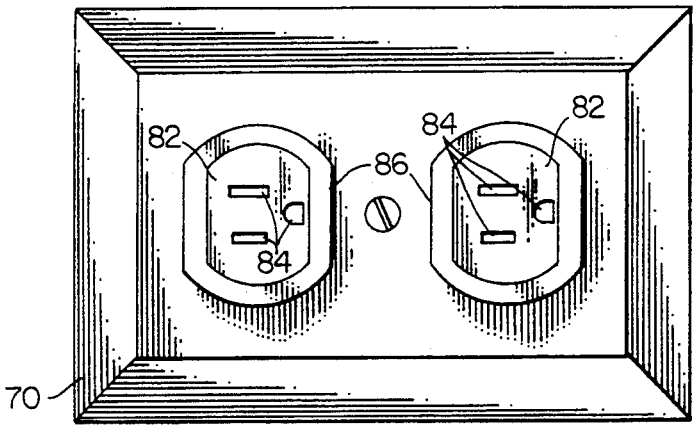
FIG. 15 is a front elevational view of the face plate of FIG. 14.
Figure 18:
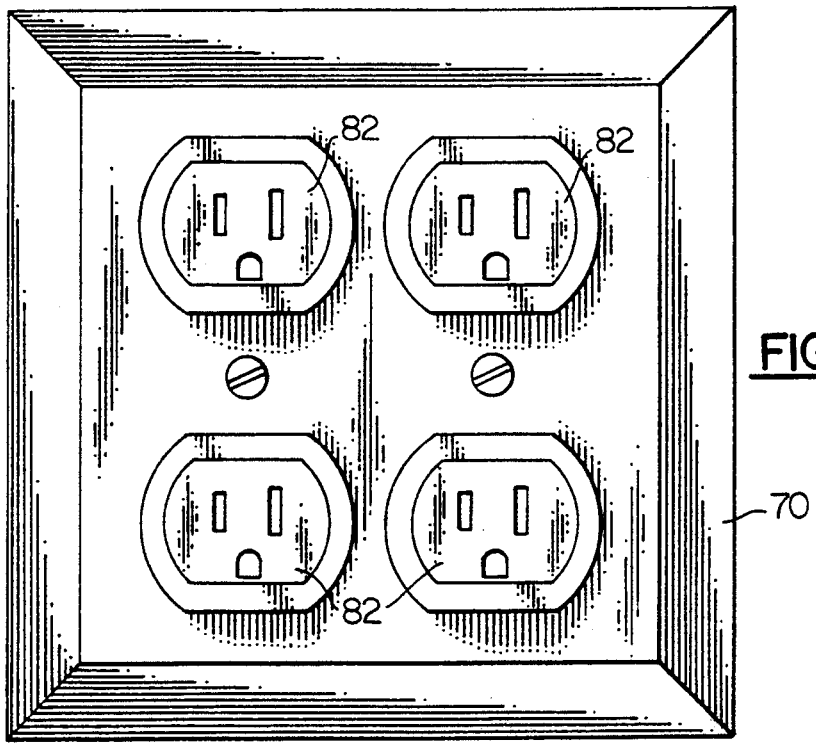
FIG. 18 is a diagrammatic representation showing a second embodiment of the face plate of FIG. 14.

FIG. 18 shows a slight variant of the face plate shown in FIGS. 14–16 in which the face plate is adapted to a be connected to a pair of side by side electrical outlets each having two receptacles, i.e. a face plate for a total of four receptacles.

Figure 19:
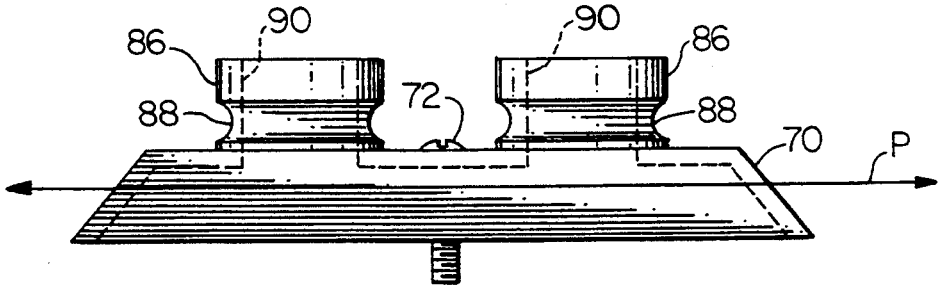
FIG. 19 is a diagrammatic left end view of a third embodiment of a face plate for an electrical outlet according to the present invention.
Figure 20:
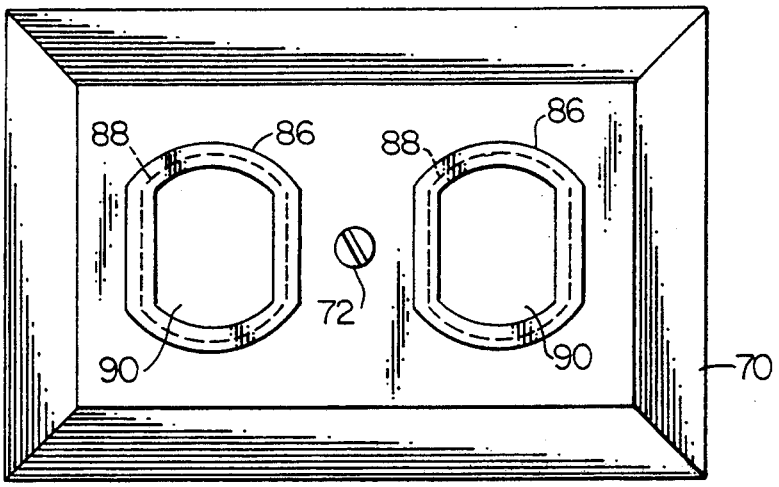
FIG. 20 is a front elevational view of the face plate of FIG. 19.
Figure 21:
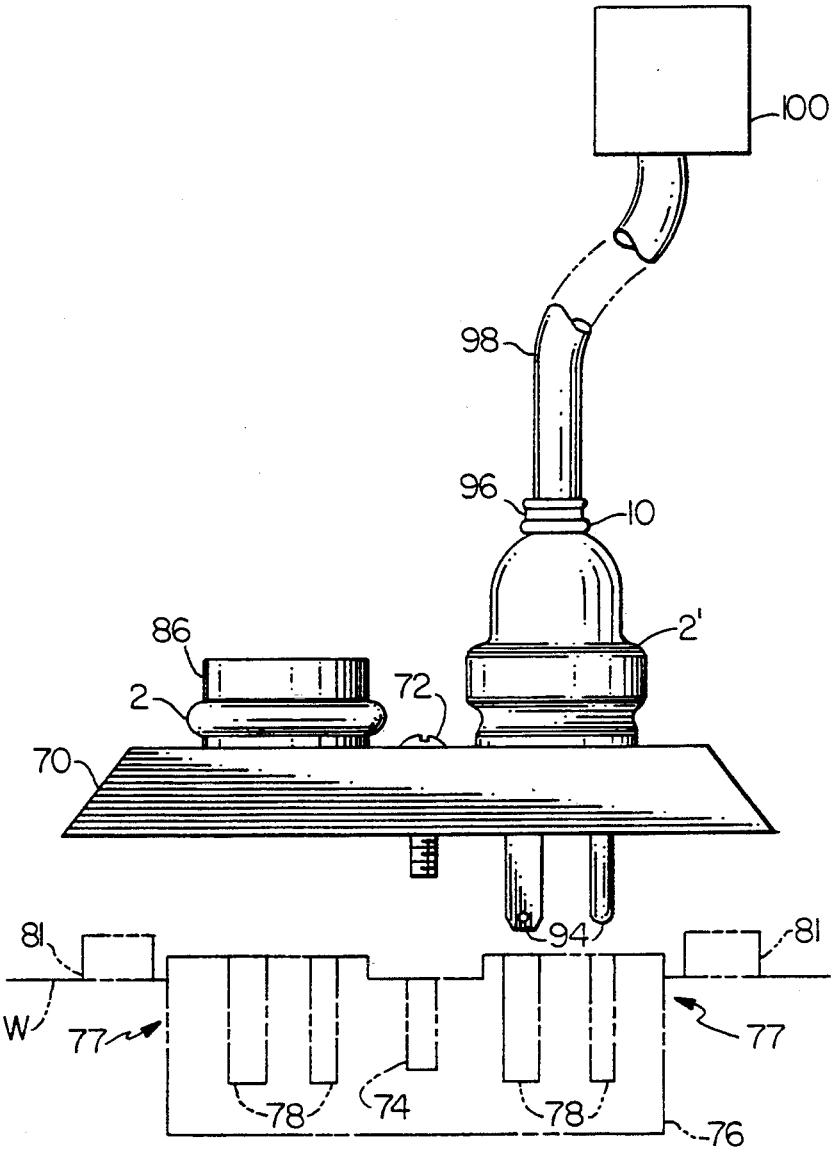
FIG. 21 diagrammatically shows operation of the face plate of FIG. 19.

Reference will now be had to FIGS. 19–21 in which a second embodiment of the face plate according to the present invention will now be discussed. As this embodiment is very similar to previously discussed embodiment, like elements are giving like reference numerals. The major difference between the second and first embodiments is that the intermediate member 82 has been eliminated in favor of a through hole or an aperture 90 extending completely through the boss 86. This enables the plug 96 of the electrical device 100 to pass through the boss 86 and directly engage, via its male contacts 94, the female contacts 78 of the receptacle 77. In this embodiment, the plug is at least partially accommodated within the through hole or aperture 90 of the boss 86, unlike the previous embodiment. Once the plug 96 is properly engaged with the receptacle 77, the tubular member 2 is then unrolled from the recess 88 over the boss 86 and the plug 96 to provide and maintain a secure engagement therebetween. If desired, the end portion of the tubular member remote from the recess 88 can be provided with a lip 10 to facilitate rolling and unrolling of the tubular member. When disconnection of the plug 96 from the receptacle 77 is desired, the tubular member 2 is rolled up and accommodated within the recess 88 so the plug 96 may be readily disconnected from the receptacle 77.

Figure 22:
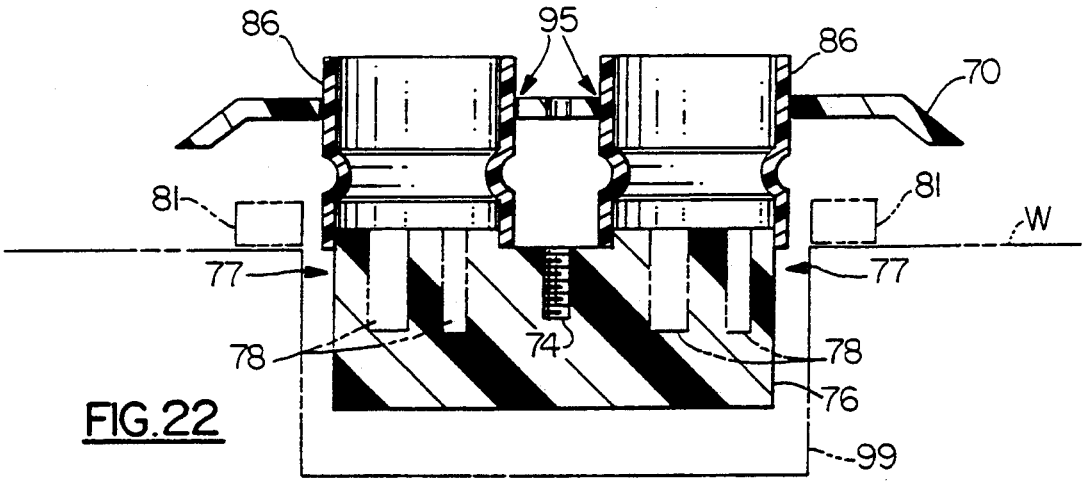
FIG. 22 shows diagrammatically shows a third embodiment for the face plate/electrical outlet arrangement of the present invention.

Turning now to FIG. 22, a third embodiment of the face plate/electrical outlet arrangement is shown. In this embodiment, the boss 86 is molded or integral formed as part of the receptacle 77 or attached directly thereto via glue, for example. The boss 86 is sized to pass through the aperture 95 of an presently available face plate 70, with a small clearance therebetween. Once the face plate 70 is securely attached to the electrical outlet 76, a tubular member 2 can then be rolled onto each boss 86 and used as described above. In this embodiment, the peripheral seal 81 may be eliminate as the bosses 86 are integral with the receptacle to prevent an leakage of moisture therebetween.

It is to be appreciated that the tubular member may be carried by the plug 96 of the electrical device 100. In such embodiment, the tubular member 2 is unrolled from the plug 96 over the exterior surface of the boss 86 to provide and maintain a secure engagement therebetween. If the exterior surface of the boss 86 is contoured, e.g. the dashed line 88' in FIG. 14, this facilitates and/or assists with rolling up of the tubular member 2 once the plug 96 and the boss 86 are to be disconnected from one another.

In all of the above described embodiments of FIG. 14–22, the electrical outlet 76 is suitable sealed, e.g. in a waterproof housing 99 (FIG. 22), with respect to the wall or other supporting member to prevent any liquid or moisture from contacting the receptacles 77 or the internal wiring of the electrical outlet. As such teaching well known in this art, further detailed discussion concerning the same is not provided herein.

The tubular member of the present invention can be used to encase and provide a substantially waterproof connection between a variety of different interconnected members. For example, the tubular member may be used to encase two interconnected hydraulic members or may be used to interconnect a variety of mating electrical members in an automobile, e.g. spark plugs. Accordingly, the present invention has a wide field of use and application.

Talc, powder or other similar lubricating material may be applied to the exterior surface of the tubular member to assist with rolling and unrolling of the tubular member and prevent the tubular member from sticking to itself.

If the tubular member is manufactured from rubber latex or other similar materials, it is preferably coated with a protective outer coating, such as urethane, to prolong the life of the tubular member and improve its physical characteristics.

Since certain changes may be made in the above described tubular member, and apparatus for facilitating rolling and transferring of the same, without departing from the spirit and scope of the invention herein involved, it is intended that all subject matter contained in the above description and shown in the accompanying drawings shall be interpreted as being illustrative of the present invention and not limiting thereof.

Wherefore, we claim:

1. An electrical outlet receptacle connecting member comprising:

an elongate boss defining an exterior surface with opposed first and second ends, the first end of said boss being configured to be encased by a resilient waterproofing tubular member and a second end of said boss for sealingly communicating with a receptacle to prevent liquid from accessing a desired plug;

opening means having an inner perimeter slightly larger than an exterior perimeter of a said desired plug, said opening means, being formed in said first end of said boss and being encompassed by said boss, for providing for an electrical connection between said desired plug and a said receptacle of an electrical outlet; and a resilient elongate tubular member formed from a single unitary piece of a substantially water impermeable material, said elongate tubular member having opposed first and second open ends, said first open end of said elongate tubular member having an inner perimeter smaller than an exterior perimeter of said boss and said second open end of said elongate tubular member having an inner perimeter smaller than an exterior perimeter of said desired plug whereby said first open end is resiliently expanded when said first open end encases said first end of said boss and said second open end is resiliently expanded when said second open end encases said desired plug so that said first and second open ends of said elongate tubular member intimately engage the exterior surface of said boss and said desired plug, respectively, thereby forming a substantially waterproof connection therebetween and minimizing the possibility that said desired plug will become disconnected from a said receptacle.

2. A receptacle connecting member according to claim 1, wherein said boss has a circumferential recess formed in an exterior surface thereof for accommodating said tubular member and forming a substantial waterproof connection between said plug and said boss and maintaining engagement therebetween.

3. An electrical outlet receptacle connecting member comprising:

an elongate boss defining an exterior surface with opposed first and second ends said first end of said boss being configured to be encased by a resilient waterproofing tubular member and a second end of said boss for sealingly communicating with a receptacle to prevent liquid from accessing a desired plug;

opening means having an inner perimeter slightly larger than an exterior perimeter of a said desired plug, said opening means, being formed in said first end of said boss and being encompassed by said boss, for providing for an electrical connection between said desired plug and a said receptacle of an electrical outlet; and a resilient elongate tubular member formed from a single unitary piece of a substantially water impermeable material, said elongate tubular member having opposed first and second open ends, said first open end of said elongate tubular member having an inner perimeter smaller than an exterior perimeter of said boss and said second open end of said elongate tubular member having an inner perimeter smaller than an exterior perimeter of said desired plug whereby said first open end is resiliently expanded when said first open end encases said first end of said boss and said second open end is resiliently expanded when said second open end encases said desired plug so that said first and second open ends of said elongate tubular member intimately engage the exterior surface of said boss and said desired plug, respectively, thereby forming a substantially waterproof connection therebetween and minimizing the possibility that said desired plug will become disconnected from a said receptacle;

wherein said second end of said boss is connected to a face plate, for an electrical outlet, sized to substantially cover a said electrical outlet to which said face plate is to be attached, and said face plate has means for securing said face plate to a said electrical outlet.

4. A receptacle connecting member according to claim 3, wherein:

said boss defines an axis;

said face plate is a substantially planar member; and said boss is supported on a first surface of said face plate and said axis of said boss extends substantially perpendicular to said planar member.

5. A receptacle connecting member according to claim 3, wherein said boss has one of a generally oval and a cylindrical transverse cross-section.

6. A receptacle connecting member according to claim 3, wherein said opening means is a through hole extending completely through said boss, said through hole is sized to facilitate passage of said plug therethrough for direct engagement with a said receptacle of a said electrical outlet, and the exterior perimeter of said boss and the perimeter diameter of said desired plug are sized to facilitate rolling and unrolling of said elongate tubular member from said first end of said boss directly onto an exterior surface of said plug and viz versa.

7. A receptacle connecting member according to claim 6, wherein said through hole accommodates an intermediate member, having a plurality of female contacts located on a first surface thereof, permanently secured within said boss, an opposite end of said intermediate member having an equal number of male contacts located thereon, and each female contact is electrically connected with a corresponding male contact.

8. A receptacle connecting member according to claim 7, wherein said face plate is a substantially planar member, and said male contacts of said intermediate member extend substantially perpendicular from a second surface of said face plate to facilitate engagement with female contacts of a said receptacle of a said electrical outlet.

9. A receptacle connecting member according to claim 7, wherein said intermediate member is made from one of an insulating material and a non-conductive material.

10. A receptacle connecting member according to claim 3, wherein said face plate supports a plurality of said receptacle connecting members thereon.

11. A receptacle connecting member according to claim 2, wherein said tubular member has a thickness of from about 15 to about 200 mils.

12. A receptacle connecting member according to claim 1, wherein said tubular member is manufactured from one of vinyl plastisol, polyvinyl chloride, nitrile latex, rubber latex, acrylic latex, liquid neoprene, thermoplastic elastomer, thermoset plastic and butyl rubber.

13. A receptacle connecting member according to claim 1, wherein said second end of said boss encompasses a said receptacle and is sealed therewith so as to provide a waterproof connection and prevent liquid from entering therebetween.

14. A receptacle connecting member according to claim 13, wherein the exterior surface of said boss is sized to pass through an opening in a face plate for said electrical outlet.

15. A receptacle connecting member according to claim 1, wherein said first open end of said resilient elongate tubular member is in engagement with and encases said first open end of said boss and said second open end of said resilient elongate tubular member is in engagement with and encases an exterior surface of said desired plug.

16. A receptacle connecting member according to claim 1, wherein an exterior surface of said tubular member is provided with a plurality of axially extending and spaced reinforcing means for substantially preventing axial stretch of said tubular member when a disconnecting force F is applied thereto while allowing resilient expansion of said tubular member.

17. A receptacle connecting member according to claim 1, wherein said tubular member is resiliently stretched between 10 and 100 percent upon encasing said boss and said desired plug.

18. A receptacle connecting member according to claim 1, wherein an exterior surface of said tubular member is provided with a lubricating material to facilitating rolling and unrolling of said tubular member.

19. A receptacle connecting member according to claim 1, wherein said tubular member is coated with a coating to protect and prolong the useful life of said tubular member.

20. A method of achieving a substantially waterproof connection between a desired plug and a receptacle of an electrical outlet via an electrical outlet receptacle connecting member comprising an elongate boss defining an exterior surface with opposed first and second ends, said first end said boss being configured to be encased by a resilient waterproofing tubular member and a second end of said boss being configured to intimately communicate with said receptacle to prevent liquid from accessing said desired plug; opening means having an inner perimeter slightly larger than an exterior perimeter of a said desired plug, said opening means, being formed in said first end of said boss and being encompassed by said boss, for providing for an electrical connection between said desired plug and a said receptacle of an electrical outlet; and a resilient elongate tubular member formed from a single unitary piece of a substantially water impermeable material, said elongate tubular member having opposed first and second open ends, said first open end of said elongate tubular member having an inner perimeter smaller than an exterior perimeter of said boss and said second open end of said elongate tubular member having an inner perimeter smaller than an exterior perimeter of said desired plug whereby said first open end of said elongate tubular member is resiliently expanded when said first open end encases said first end of said boss and said second open end of said elongate tubular member is resiliently expanded when said second open end encases said desired plug so that said first and second open ends of said elongate tubular member intimately engage the exterior surface of said boss and said desired plug, respectively, thereby forming a substantially waterproof connection therebetween and minimizing the possibility that said desired plug will become disconnected from a said receptacle;

said method comprising the steps of:

applying said tubular member, in at least a partially rolled-up donut configuration, onto one of said first end of said boss and said desired plug;

forming an electrical connection between said desired plug and a said receptacle via said opening means;

unrolling said at least partially rolled-up tubular member from one of said boss and said plug to the other of said boss and said plug so that said tubular member is resiliently expanded and directly engages both the exterior surface of said boss and the exterior surface of said desired plug thereby forming a substantially waterproof connection therebetween.

* * * * *